US010358864B2

(12) United States Patent
Blackburn et al.

(10) Patent No.: US 10,358,864 B2
(45) Date of Patent: Jul. 23, 2019

(54) SHUTTERS AND SHUTTER HINGE ELEMENTS

(71) Applicant: Houston Shutters, LLC, Houston, TX (US)

(72) Inventors: Michael Blackburn, Houston, TX (US); Jennifer Baur, Houston, TX (US)

(73) Assignee: Houston Shutters, LLC, Houston, TX (US)

( * ) Notice: Subject to any disclaimer, the term of this patent is extended or adjusted under 35 U.S.C. 154(b) by 0 days.

(21) Appl. No.: 15/158,354

(22) Filed: May 18, 2016

(65) Prior Publication Data

US 2016/0340971 A1 Nov. 24, 2016

Related U.S. Application Data

(60) Provisional application No. 62/163,343, filed on May 18, 2015.

(51) Int. Cl.
*E06B 7/09* (2006.01)
*E06B 3/04* (2006.01)
(Continued)

(52) U.S. Cl.
CPC ..... *E06B 7/09* (2013.01); *E06B 1/04* (2013.01); *E06B 1/36* (2013.01); *E06B 3/04* (2013.01);
(Continued)

(58) Field of Classification Search
CPC ..... E06B 7/08–098; E06B 1/00–528; E06B 1/702; E06B 9/04; E04B 7/02; E04B 7/08; E04B 7/09; E04B 7/10
(Continued)

(56) References Cited

U.S. PATENT DOCUMENTS 2,666,945 A * 1/1954 Kelly ..... E05D 5/023 16/221
2,853,162 A * 9/1958 David ..... E05D 5/04 16/250
(Continued)

FOREIGN PATENT DOCUMENTS

DE 19527328 A1 1/1997
FR 2494333 A1 * 5/1982 ..... E06B 1/347
GB 778136 A * 7/1957 ..... E06B 1/52

OTHER PUBLICATIONS

"The Making of an Aluminium Window" uploaded by Glen Wilson, Aug. 2, 2014, Internet: <URL:https://www.youtube.com/watch?v=BbJMOWewmMo>.
(Continued)

*Primary Examiner* — Marcus Menezes
(74) *Attorney, Agent, or Firm* — Conley Rose, P.C.

(57) ABSTRACT

A shutter assembly includes a frame with a pair of elongate side members and a pair of elongate cross members extending between the side members. The first side member includes an inwardly-facing frame surface in a region between the pair of cross members and further includes a frame-ledge extending inward beyond the inwardly-facing frame surface. The shutter assembly includes a shutter panel having a first stile pivotally coupled to the first side member of the frame, the shutter panel configured to swing between a closed position and an open position relative to the frame. The first stile includes a shutter recessed surface, and a shutter-ledge extending outwardly beyond the shutter recessed surface. For light-blocking purposes the shutter assembly is configured such that the shutter-ledge is positioned adjacent to the frame-ledge when the shutter panel is in the closed position.

14 Claims, 11 Drawing Sheets

(51) Int. Cl.

| | |
|---|---|
| ***E06B 1/04*** | (2006.01) |
| ***E06B 7/086*** | (2006.01) |
| ***E06B 1/36*** | (2006.01) |
| ***E06B 3/36*** | (2006.01) |
| ***E06B 9/04*** | (2006.01) |
| *E05D 3/02* | (2006.01) |
| *E05D 5/04* | (2006.01) |

(52) U.S. Cl.
CPC ..... *E06B 3/365* (2013.01); *E06B 7/086* (2013.01); *E06B 9/04* (2013.01); *E05D 3/02* (2013.01); *E05D 5/04* (2013.01); *E05Y 2900/146* (2013.01)

(58) Field of Classification Search
USPC ..... 16/391
See application file for complete search history.

(56) References Cited

U.S. PATENT DOCUMENTS 3,251,156 A * 5/1966 Zitomer ..... E06B 1/526 105/281
3,298,135 A * 1/1967 Kinser ..... E05D 3/02 16/262
3,469,350 A * 9/1969 Lange ..... E06B 1/045 49/504
3,649,060 A * 3/1972 Ruff ..... E05C 1/04 292/147
3,654,734 A * 4/1972 Lehman ..... E06B 1/20 49/505
3,872,541 A * 3/1975 Peterson ..... E05D 11/0081 16/223
4,104,828 A * 8/1978 Naslund ..... E06B 5/16 428/45
4,203,255 A * 5/1980 Naslund ..... B32B 21/10 428/326
4,547,930 A * 10/1985 King ..... E05D 5/023 16/247
4,656,691 A * 4/1987 Allen ..... E05B 15/0205 16/251
5,778,598 A * 7/1998 Ohanesian ..... B29C 47/0023 49/403
6,266,923 B1 * 7/2001 Lee ..... E06B 7/086 49/74.1
6,732,475 B1 * 5/2004 Lee ..... E06B 7/09 49/505
2002/0020124 A1 * 2/2002 Kusano ..... E05D 7/02 52/213
2004/0140062 A1 7/2004 Lee
2005/0204630 A1 * 9/2005 Nien ..... E06B 7/09 49/74.1
2008/0127565 A1 * 6/2008 Taylor ..... E05D 5/06 49/394
2008/0222979 A1 * 9/2008 Rissmiller ..... E06B 1/60 52/213
2011/0030294 A1 * 2/2011 Clarson ..... E06B 7/08 52/203
2014/0069038 A1 * 3/2014 Back ..... E06B 1/52 52/210
2014/0298615 A1 * 10/2014 Gouge ..... E05D 3/02 16/221
2014/0352218 A1 * 12/2014 Blackburn ..... E06B 7/09 49/92.1
2016/0053527 A1 * 2/2016 Olson ..... E06B 3/365 52/210

OTHER PUBLICATIONS

International Search Report and Written Opinion for International Application No. PCT/US2016/033122 filed May 18, 2016.

* cited by examiner

SHUTTERS AND SHUTTER HINGE ELEMENTS

CROSS-REFERENCE TO RELATED APPLICATIONS

This application claims benefit of U.S. provisional patent application Ser. No. 62/163,343 filed May 18, 2015, and entitled "Shutter and Methods for Forming Same," which is hereby incorporated herein by reference in its entirety for all purposes.

STATEMENT REGARDING FEDERALLY SPONSORED RESEARCH OR DEVELOPMENT

Not applicable.

BACKGROUND

Field of the Disclosure

This disclosure relates generally to frames for holding objects or for aesthetically accenting objects. More particularly, it relates to frames for holding shutter panels, and to assemblies of frames and shutter panels that are applicable for installation adjacent windows or doors.

Background Information

The design, fabrication, assembly, and installation of shutters (i.e. shutter panels or shutter assemblies) for window and door openings or casings can add storm protection, privacy, or aesthetic beauty to homes and other buildings. Some shutters are functional, such as panels that pivotally mount to a window or door casing, allowing the panels to be selectively pivoted to cover a window or door opening or pivoted to the side of the opening. Other shutters are cosmetic, giving aesthetic appeal without allowing movement. Panels for functional or cosmetic shutters commonly include a series of louvers, e.g. over-lapping boards. For functional shutters, the louvers may be pivotable or may be rigid relative to a panel frame.

Design features that improve the appearance or performance of shutters; that reduce manufacturing, assembly, and/or transportation costs; and/or that simplify the assembly of shutters are desirable to maintain an economic or other competitive advantage.

BRIEF SUMMARY OF THE DISCLOSURE

In an embodiment, a shutter assembly includes a frame with a pair of elongate side members and a pair of elongate cross members extending therebetween. The first side member includes an inwardly-facing frame surface in a region between the pair of cross members and further includes a frame-ledge extending inward beyond the inwardly-facing frame surface by a distance D1. The shutter assembly includes a shutter panel having a first stile that is pivotally coupled to the first side member of the frame, and is configured to swing between a closed position and an open position. Moreover, the first stile includes a shutter recessed surface, and a shutter-ledge extending outwardly beyond the shutter recessed surface. The shutter-ledge is positioned adjacent to the frame-ledge when the shutter panel is in the closed position.

In some embodiments, the shutter panel has a front shutter-face, a rear shutter-face, and the shutter recessed surface extends from the front shutter-face toward the rear shutter-face. The frame-ledge may include a face that is generally parallel to the rear shutter-face of the shutter panel when the shutter panel is closed, and the shutter-ledge may include an outwardly-facing shutter surface facing the inwardly-facing frame surface and separated from the inwardly-facing frame surface by a predetermined gap when the shutter panel is closed. Consequently, when the shutter panel is closed, the frame-ledge in this embodiment extends inwardly beyond the gap and beyond the outwardly-facing shutter surface.

Further, in some of these embodiments, the shutter assembly include a hinge having a first mounting plate attached to the inwardly-facing frame surface, and a second mounting plate attached to the shutter recessed surface. In some embodiments, the first mounting plate extends beyond the inwardly-facing frame surface by the plate's thickness T that is less than D1.

In some other embodiments, the shutter assembly includes a frame having a first and a second side member; a first and a second cross member, spaced apart and extending between the side members; a front frame-face; a rear frame-face spaced apart from the front frame-face; an inwardly-facing frame surface extending from the front frame-face toward the rear frame-face; and a frame-ledge extending away from the inwardly-facing frame surface. In this embodiment, the shutter assembly includes a shutter panel pivotally coupled to the frame by a hinge, the shutter panel having a front shutter-face; and a rear shutter-face spaced apart from the front shutter-face. When the shutter panel is closed, a hinge gap extends between the shutter and the inwardly-facing frame surface and the hinge is at least partially disposed the hinge gap.

Further, for at least some of these other embodiments, the shutter panel further includes a shutter recessed surface extending from the front shutter-face toward the rear shutter-face, and the hinge gap is formed between the shutter recessed surface and the inwardly-facing frame surface when the shutter panel is closed.

In still another embodiment, a shutter assembly includes a frame having a side member with an elongate inwardly-facing frame surface and an elongate frame-ledge that extends beyond the inwardly-facing frame surface by a distance D1. In this embodiment, the shutter assembly includes a shutter panel coupled to the frame by a hinge configured to enable the shutter panel to pivot between open and closed positions, the shutter panel comprising an elongate shutter surface that is parallel to the inwardly-facing frame surface when the shutter is in the closed position. Further, this shutter assembly includes a hinge gap between the inwardly-facing frame surface and the elongate shutter surface when the shutter is in the closed position. The hinge comprises first and second mounting plates that are axially spaced along a hinge pin and disposed in the hinge gap, the first mounting plate attached to the inwardly-facing frame surface and the second mounting plate attached to the elongate shutter surface.

In another embodiment, a method for fabricating a shutter assembly includes forming an elongate member of stock material having a first groove adjacent a ledge, wherein both the groove and the ledge extend the full length of the member of stock material. In addition, the method includes cutting from the member of stock material a first and a second side member. Further, this method includes fabricating a frame having cross-members extending between the first and second side members previously cut from the member of stock material, and mounting a non-mortise hinge in the first groove, and attaching a stile of a shutter panel to the hinge. The first groove and the hinge are located between the first side member and the stile.

Thus, the various embodiments described herein comprise a combination of features and characteristics intended to address various shortcomings associated with certain prior devices, systems, and methods. The various features and characteristics described above, as well as others, will be readily apparent to those of ordinary skill in the art upon reading the following detailed description, and by referring to the accompanying drawings.

BRIEF DESCRIPTION OF THE DRAWINGS

For a detailed description of the disclosed exemplary embodiments, reference will now be made to the accompanying drawings in which.

NOTATION AND NOMENCLATURE

Figure 1:
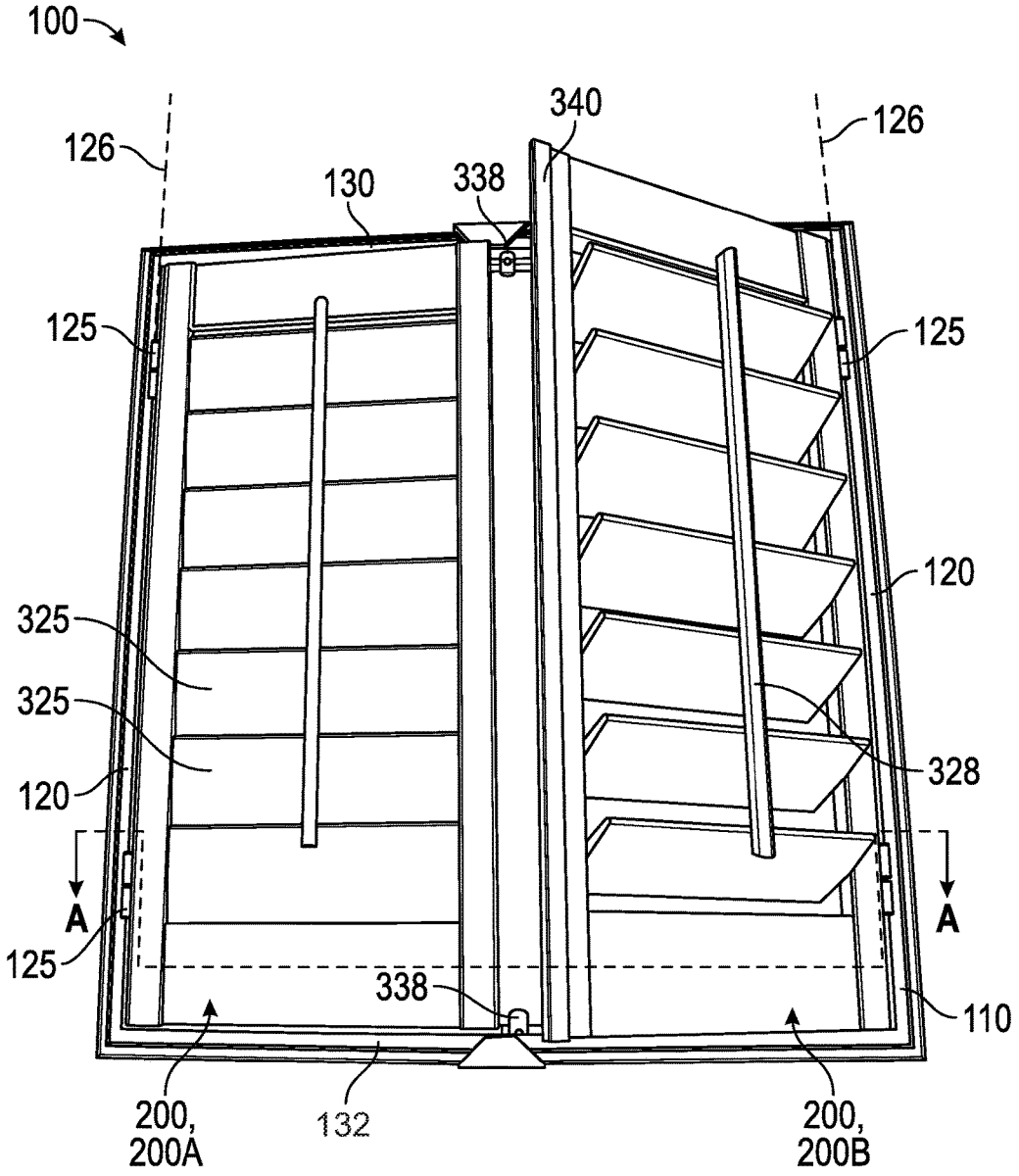
FIG. 1 is a perspective front view of a shutter assembly in accordance with principles described herein, the assembly shown with both shutter panels of the assembly slightly open.

The following description is exemplary of certain embodiments of the disclosure. One of ordinary skill in the art will understand that the following description has broad application, and the discussion of any embodiment is meant only to be exemplary of that embodiment, and is not intended to suggest in any way that the scope of the disclosure, including the claims, is limited to that embodiment.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness of the figure, one or more components or aspects of a component may be omitted or may not have reference numerals identifying the features or components that are identified elsewhere. In addition, among the drawings, like or identical reference numerals may be used to identify common or similar elements.

The terms "including" and "comprising" are used herein including the claims, in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, X may be based on Y and any number of other factors.

In addition, as used herein including the claims, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to a given axis, and a radial distance means a distance measured perpendicular to the axis. Distances between surfaces, faces, or objects are to be measured as the perpendicular distances between those features or between geometric extensions of those features. As understood in the art, the use of the terms "parallel" and "perpendicular" may refer to precise or idealized conditions as well as to conditions in which the members may be generally parallel or generally perpendicular, respectively. Any reference to a relative direction with respect to an object, for example "top," "bottom," "up", "upward," "left," "leftward," "left-hand," "right-hand," "down", and "lower" is made for purpose of clarification and pertains to the orientation of a particular Figure or embodiment being described. If the object were viewed from another orientation or implemented in another orientation, it may be appropriate to described direction using an alternate term.

DETAILED DESCRIPTION OF THE DISCLOSED EXEMPLARY EMBODIMENTS

This disclosure presents a frame and a shutter panel, which may be formed into a shutter assembly, all of which are applicable to fenestration, i.e. window and door openings, frames, or casings. In various embodiments, the shutter assembly includes one or more shutter panels coupled to a frame. The shutter panel may include multiple louvers. In at least some embodiments, the shutter assembly is functional, having a shutter panel pivotally mounted to the frame, allowing the panel to be selectively positioned within the window or door opening or to the side of the opening. That is to say, the shutter panel is configured to swing between a closed position and an open position relative to the frame. Various embodiments disclosed herein have improved light-blocking capability as compared to traditional shutters.

Figure 2:
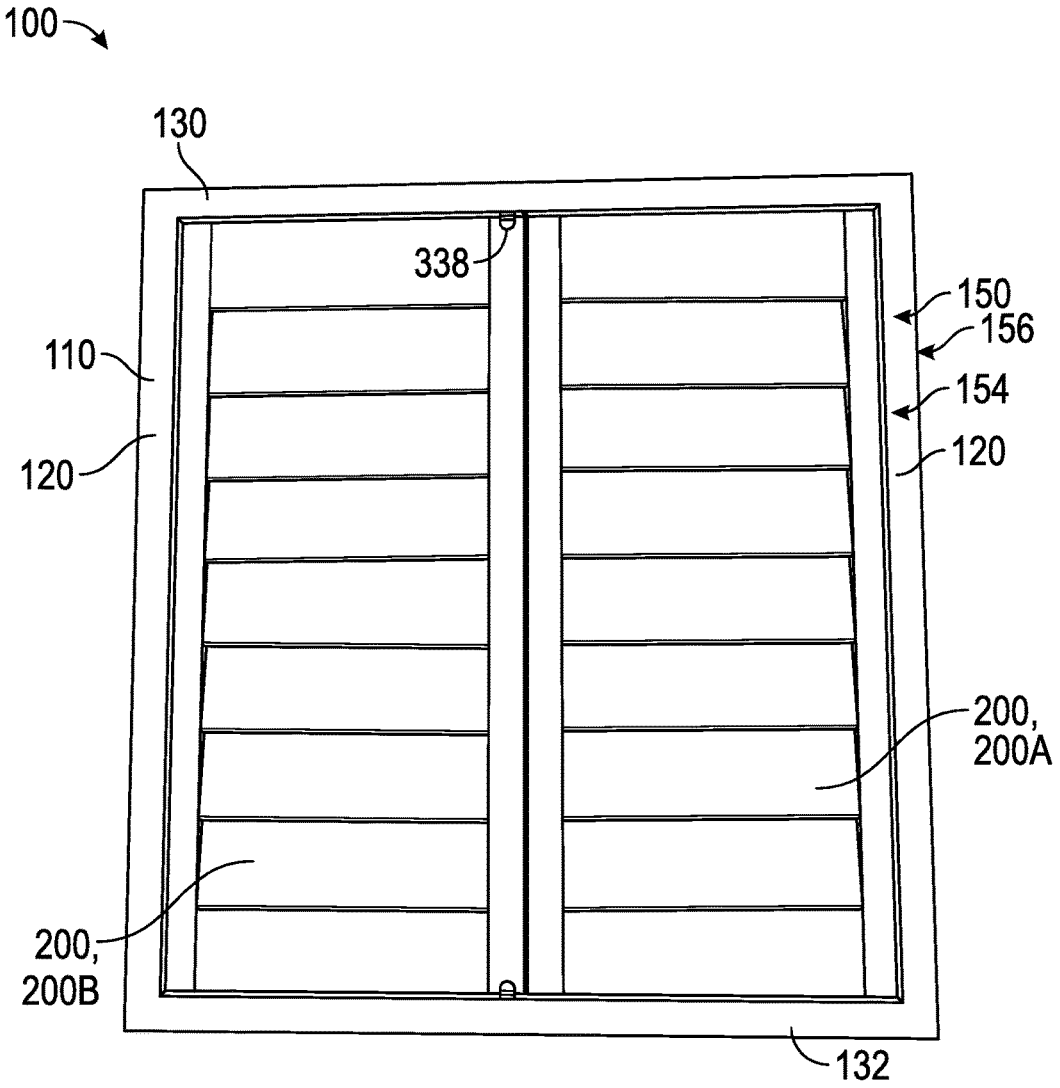
FIG. 2 is a rear elevation view of the shutter assembly of FIG. 1, the assembly shown with both shutter panels closed.
Figure 3:
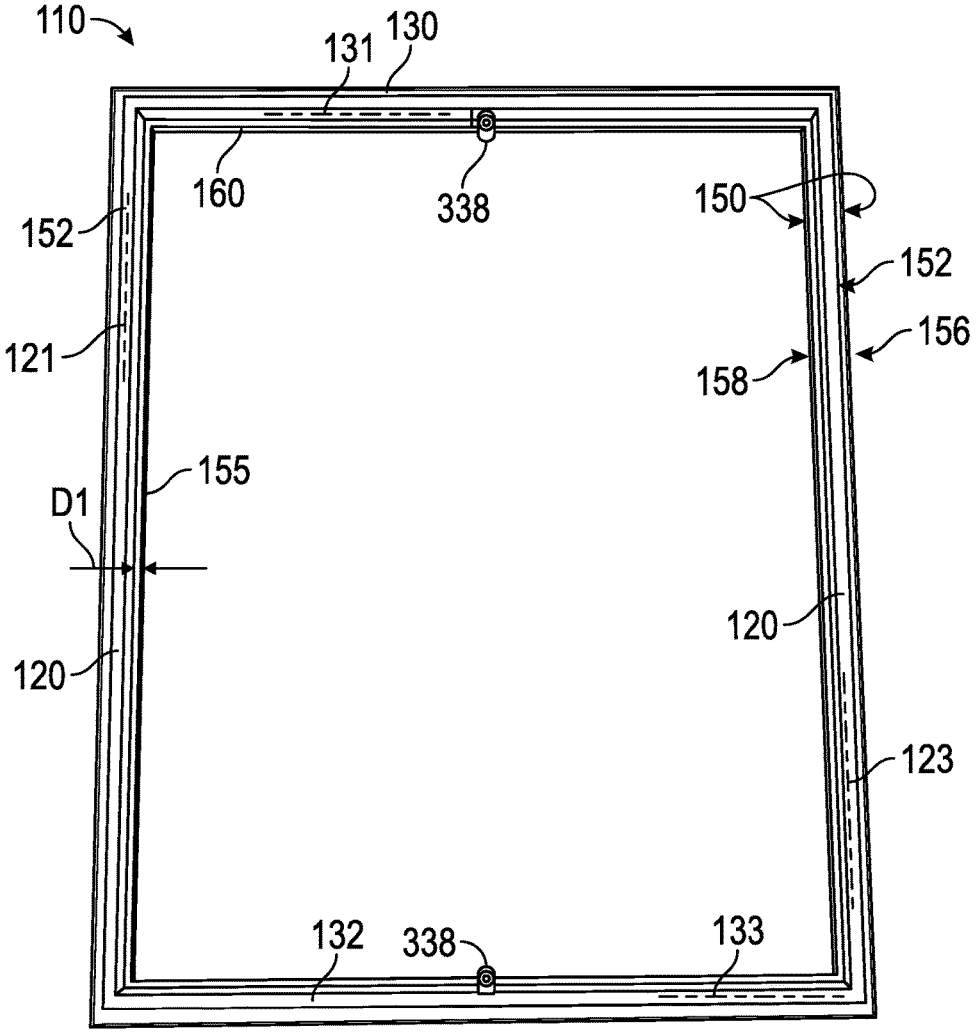
FIG. 3 is a front elevation view of the frame of the shutter assembly of FIG. 1.

Referring to FIG. 1 an exemplary embodiment of a shutter assembly is shown in perspective view. Shutter assembly 100 includes a shutter frame 110 and multiple shutter panels, each shutter panel pivotally coupled to frame 110 by at least one rotatable coupler. In this embodiment, the shutter panels are two louvered panels 200 having rotatable louvers, and each panel 200 is pivotally coupled to frame 110 by two hinges 125, which are the rotational couplers. In FIG. 1, louvered panels 200 are shown in a partially open position or open configuration, one panel 200 being rotationally displaced from frame 110. FIG. 2, shows a rear view of shutter assembly 100 with the panels 200 closed. FIG. 3 shows features of frame 110, and FIG. 4 shows a close view of the pivotal attachment of louvered panel 200 to frame 110.

Referring now to FIG. 2 and FIG. 3, frame 110 includes multiple side members and multiple cross members extending between the side members. In this example, frame 110 includes a pair of elongate side members 120 and a pair of elongate, generally parallel cross members 130, 132 spaced-apart from one another and extending between the side members 120. Each side member 120 extends along a separate longitudinal axis, which may be called a side-member axis 121, 123 and may be centered left-to-right or front-to-back through the side member or may pass through the center of mass. Upper and lower cross members 130, 132 each extend along a separate longitudinal axis, which may be called a cross-member axis 131, 133, respectively, and may be centered left-to-right or front-to-back through the side member or may pass through the center of mass. In the orientation shown for frame 110, side members 120 are vertical, and cross members 130, 132 are horizontal.

Figure 4:
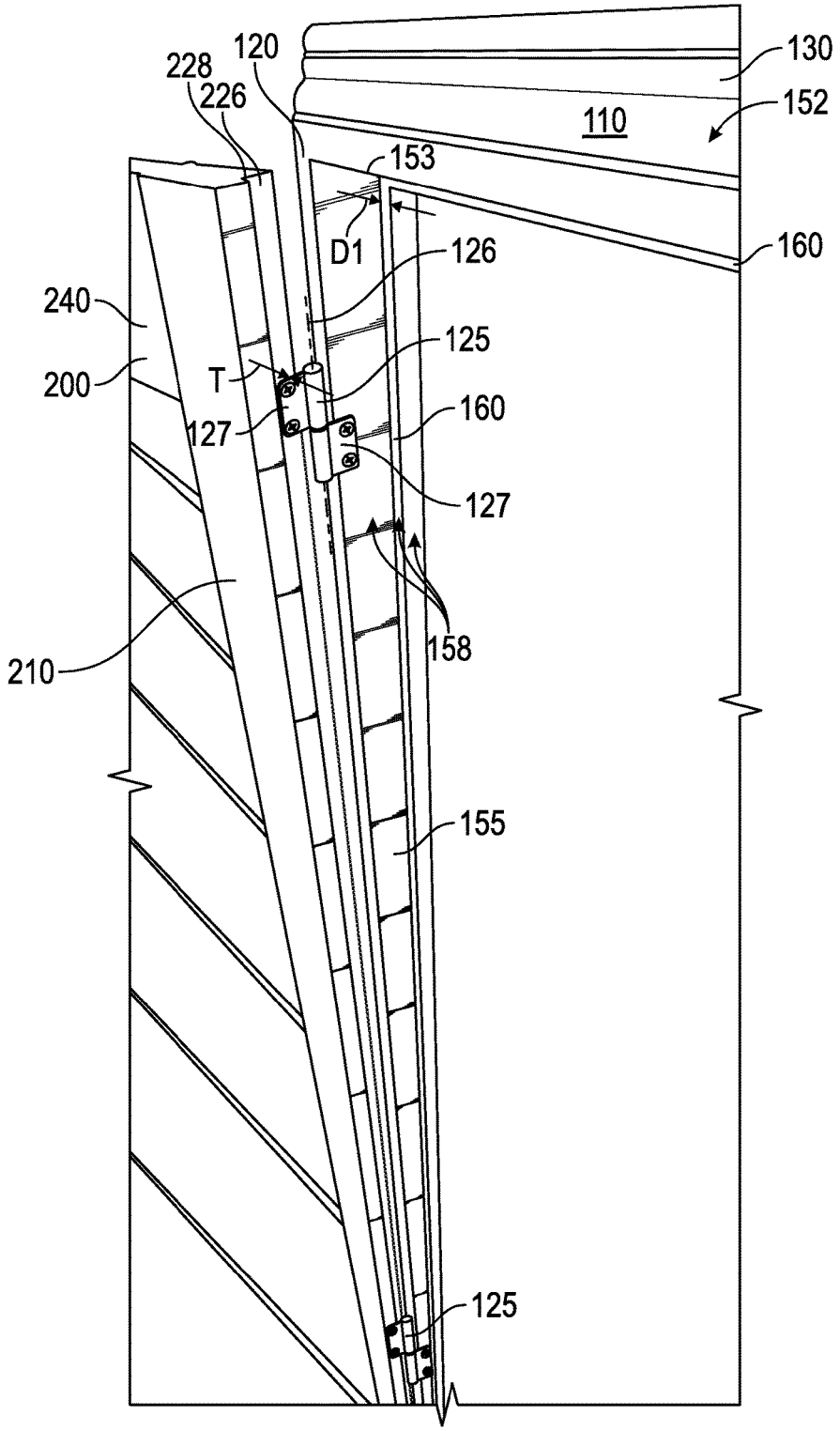
FIG. 4 is a perspective front view of the shutter assembly of FIG. 1 showing a portion of one of the shutter panels rotated on a non-mortise hinge to an open position with respect to the frame.

Referring to FIG. 3 and FIG. 4, frame 110 further includes a surface 150 comprising several regions and features, such as a front frame-face 152, a rear frame-face 154 that is opposite front frame-face 152, a perimeter frame-face 156, and an inside or interior frame-face 158. Interior frame-face 158 includes an inwardly-facing frame surface 155 extending from the front frame-face 152 toward the rear frame-face 154 and terminating at a light-blocking frame-ledge 160. Inwardly-facing frame surface 155 is open toward the center of the assembled frame 110. In FIG. 4, frame surface 155 is planar, free of recesses. Frame-ledge 160 defines a light-blocking feature that extends in a front-to-back direction, from the inwardly-facing frame surface 155 toward the rear frame-face 154, and extends in an inward direction, i.e. from the plane of frame surface 155 toward the center of the assembled frame 110. In the embodiment shown, frame-ledge 160 extends in the inward direction by a frame-ledge distance D1, and it also extends around the entire interior frame-face 158 of frame 110. Thus, the interior frame-face 158 is defined at least in part by the frame surface 155 and at least in part by frame-ledge 160. Also, in this embodiment, the frame's surface 150, frame-ledge 160, and frame surface 155 all extend around or along the entire length of frame side members 120 and the frame cross members 130, 132.

Each louvered panel 200 is coupled to one of the side members 120 of frame 110 by a pair of hinges 125, each pair of hinges having a common axis of rotation 126 parallel to the side member 120.

Figure 5:
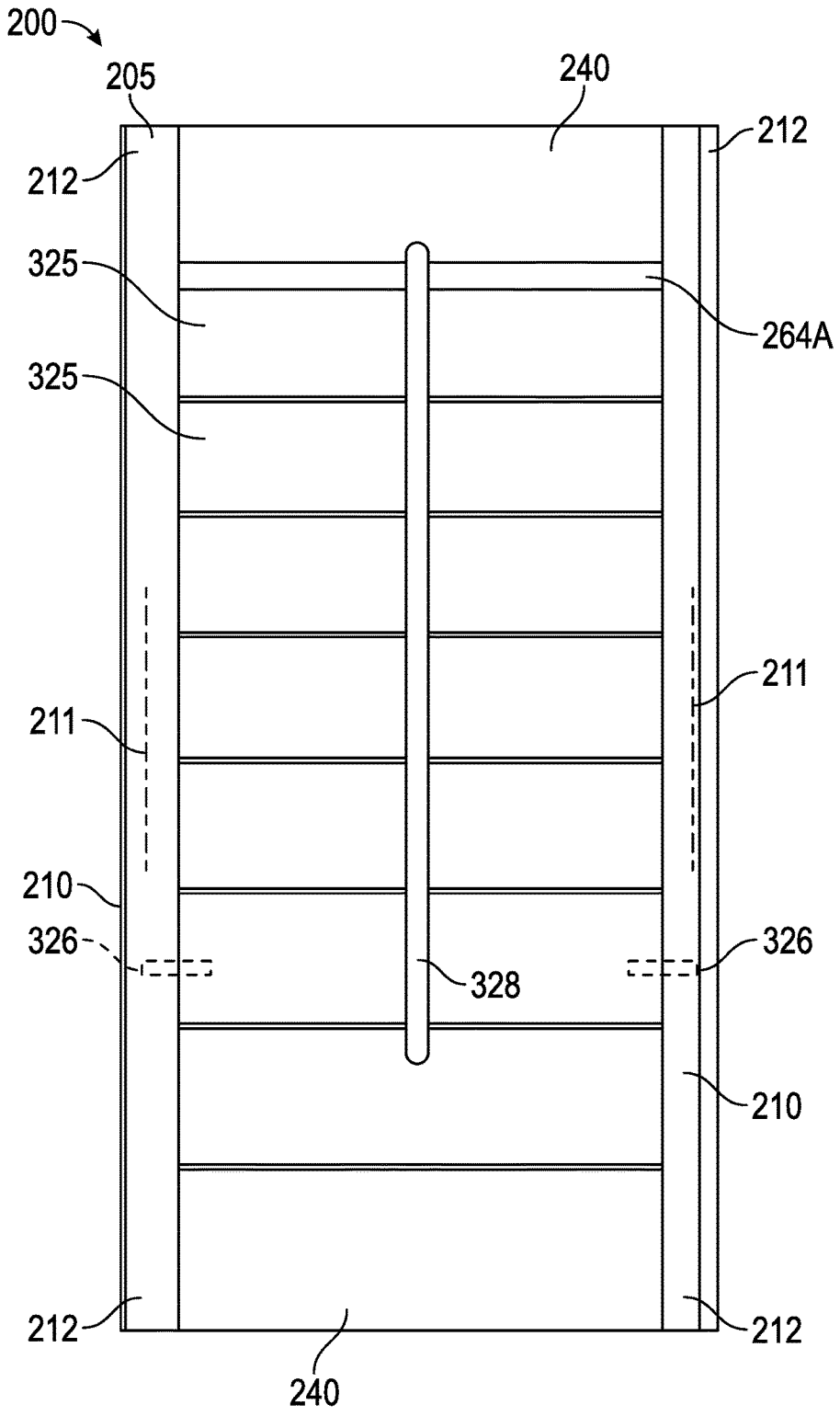
FIG. 5 is a front elevation view of a shutter panel of the shutter assembly of FIG. 1 in accordance with principles described herein.

Referring to FIG. 5 louvered panel 200 includes a panel frame 205, multiple louvers 325, and a lifting bar 328 coupled to the louvers by fasteners (not shown) that allow relative movement between louvers 325 and bar 328. Panel frame 205 includes a pair of parallel, spaced-spaced apart stiles 210 and a pair of parallel rails 240 that are spaced-apart and that extend between and generally perpendicularly to the stiles 210. Louvers 325 are elongate and have two cylindrical axis pins 326 mutually aligned and extending from opposing ends of louver 325. In this example, each pin 326 is received within a hole formed within louver 325. In the assembled louvered panel 200, the two pins 326 rotationally couple the louver 325 between the two stiles 210, parallel to rails 240.

Figure 6:
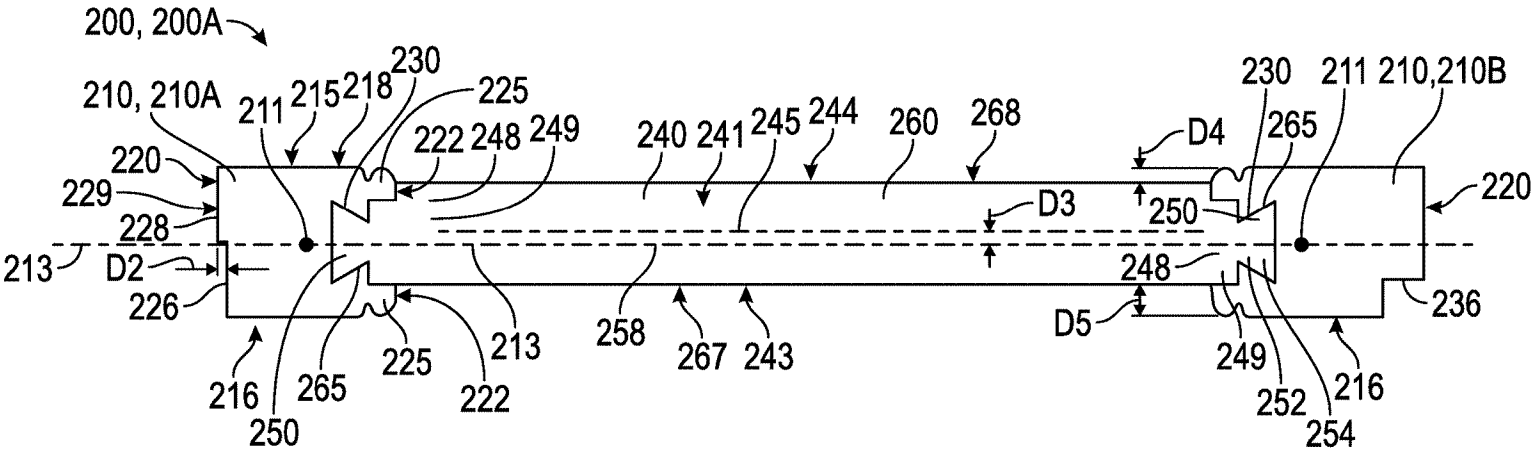
FIG. 6 is a top end view of the left-hand shutter panel of FIG. 1.
Figure 7:
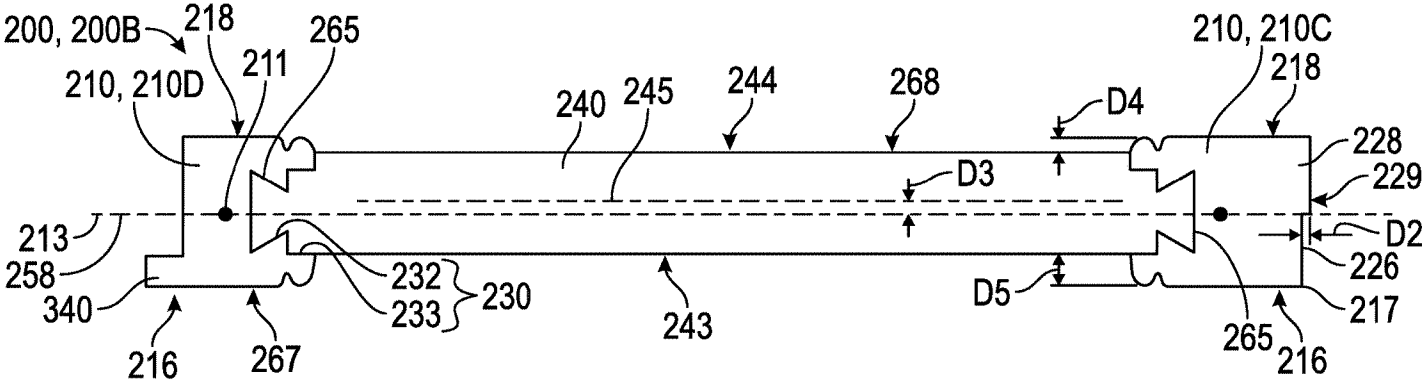
FIG. 7 is a top end view of the right-hand shutter panel of FIG. 1.

Referring to FIGS. 5-7, each stile 210 of panel 200 includes a central, longitudinal axis 211 and two spaced-apart ends 212. Best shown in the end view of FIG. 6, stile 210 also includes a longitudinally extending stile bisection plane 213 that intersects axis 211, a stile surface 215, and a longitudinal joining-groove 230 that extends the full length of stile 210. Groove 230 has an inner, trapezoidal portion or section 232 and an outer, rectangular portion or section 233. Other shaped grooves 230 may be employed, including grooves characterized by other geometric shapes and grooves having a shape more complex or less complex than the groove 230 that is shown. Surface 215 of stile 210 includes four faces or surfaces: a front stile-face 216, a rear stile-face 218, an elongate perimeter stile-face 220 between the stile-faces 216, 218, and an inside stile-face 222 distal the perimeter stile-face 220. The stile bisection plane 213 is disposed midway between the front and rear stile-faces 216, 218 and, in this embodiment, is generally parallel to stile-faces 216, 218. In at least some embodiments, plane 213 passes through the stile's center of gravity. Groove 230 intersects the inside stile-face 222, leaving two shoulders 225, one on each side of groove 230. The first shoulder 225 adjoins front stile-face 216, and the second shoulder 225 adjoins rear stile-face 218. Thus, groove 230 is disposed between the front and rear stile-faces 216, 218. In some embodiments, groove 230 is disposed midway between the front and rear stile-faces 216, 218 without intersecting the stile-faces 216, 218. When stile 210 is assembled into panel 200, perimeter stile-face 220 is an elongate shutter surface located along the perimeter of panel 200, and is parallel to the inwardly-facing frame surface 155 when the shutter is in the closed position.

Returning to FIG. 1, an elongate lip 340, which is also called an astragal, is disposed at the front surface of one of the louvered panels 200 and extends lengthwise along the edge of one of the stiles 210 that is disposed near the center of frame 110. The astragal 340 extends from the louvered panel 200 in a transverse direction to cover a portion of the other louvered panel 200 in various instances. Astragal 340 may be a separate member that is attached to a stile 210 or may be an integral part of a stile 210. A magnetic latch (not shown) is coupled to the backside of the same panel 200 that has the astragal 340. Two stop-brackets 338 are attached to frame 110, one stop-bracket 338 on each of the cross members 130. The combination of astragal 340, the magnetic latches, and the two stop-brackets 338 configure the two louvered panels 200 to be releasably disposed or retained within frame 110, generally parallel to cross members 130, 132, i.e. to be selectively held closed with respect to frame 110. Rotation of a louvered panel 200 about its axis of rotation 126 in a direction away from cross members 130 opens the panel with respect to frame 110. In some embodiments, one or both panels 200 may be closed without the aid of an astragal, magnetic latch, or a stop-bracket. Astragal 340 is light-blocking feature disposed between or adjacent two shutter panels and distal the frame.

FIG. 6 shows left-hand louvered panel 200A, and FIG. 7 shows right-hand louvered panel 200B as may be used in the shutter assembly of FIG. 1.

In at least some embodiments, a panel 200 includes a pair of stiles 210 that have similar but not-identical cross sectional shapes. In the example of FIG. 6, left-hand louvered panel 200A has an outer stile 210A and an inner stile 210B. The description of "outer" and "inner" refer to the arrangement in which outer stile 210A is located or disposed closer to frame 110 in shutter assembly 100 and inner stile 210B is located toward the center of frame 110 in shutter assembly 100. Various common features of stiles 210 discussed earlier are descriptive of the each stile 210A, 210B. In addition, outer stile 210A includes a shutter recessed surface 226 extending in depth from the front stile-face 216 toward the rear stile-face 218 and includes a light-blocking shutter-ledge 228 extending from the surface 226 toward the rear stile-face 218. Shutter-ledge 228 includes an outwardly-facing shutter surface 229, which lies along a portion of the perimeter of louvered panel 200 and is perpendicular to plane 213 and perpendicular to the front and rear stile-faces 216, 218. Surface 226 is recessed by a distance D2 from the shutter surface 229 in a direction parallel to plane 213. Alternatively stated, shutter-ledge 228 extends a distance D2 outward from recessed surface 226. On outer stile 220A, perimeter stile-face 220 comprises surfaces 226, 229, each being an elongate shutter surface that is parallel to the inwardly-facing frame surface 155 when the shutter is in the closed position. As shown in FIGS. 4 and 6, shutter recessed surface 226 is planar and extends along the full-length of outer stile 210A, which forms a side of the panel 200, and the shutter-ledge 228 also extends the full-length of outer stile 210A. Shutter-ledge 228 is a light-blocking feature on outer stile 210A. Inner stile 210B of panel 200A includes a clearance recess 236 at the corner between the front stile-face 216 and the perimeter stile-face 220 to receive astragal 340 when both louvered panels 200A, 200B are closed, disposed within frame 110.

FIG. 7 similarly shows that a right-hand louvered panel 200B may also have two stiles 210C, 210D that have similar but not-identical cross sectional shapes. Various common features of stiles 210 discussed earlier are descriptive of each stile 210C, 210D. Outer stile 210C may be a mirror image of stile 210A (FIG. 6), so that stiles 210A, 210C may be formed from a common piece of material and inverted top-to-bottom with respect to one another during fabrication. Like stile 210A, stile 210C includes a shutter recessed surface 226 extending from the front stile-face 216 toward the rear stile-face 218 and includes a light-blocking shutter-ledge 228 extending from the shutter recessed surface 226 toward the rear stile-face 218. Inner stile 210D of panel 200B includes astragal 340 extending axially from front stile-face 216.

Referring again to FIG. 4, the rotatable couplers, which in this example are two non-mortise hinges 125, pivotally couple the louvered panel 200 to the frame 110. Each hinge 125 includes two mounting plates 127 displaced from one another along the axis of rotation 126. Each mounting plate 127 has a pair of generally planer surfaces separated by the plate thickness T, and when rotated to be aligned end-to-end (as occurs when a shutter panel 200 is closed for example), the surfaces of the two mounting plates are co-planar, and the two plates together occupy just the thickness T, not twice the thickness T as is the case for mortise-style hinges. The first mounting plate 127 is attached to the inwardly-facing frame surface 155 on the one of the side members 120, extending inward beyond surface 155 by the thickness T. The second mounting plate 127 is attached to the shutter recessed surface 226 of the stile 210. As shown and described, hinge 125 is partially disposed adjacent the surface 155 and in the shutter recessed surface 226 without a mortise, that is to say, without a recess that is cut to match the width, the thickness, and the length of the hinge's mounting plates. The surfaces 155, 226 perform as mounting grooves or channels capable of receiving a plurality of hinges 125, replacing traditional pairs of opposing mortises that receive one hinge each. At least before the hinge 125 is installed, mounting plates 127 of this particular "two-leaf," non-mortise hinge are configured to swing past each other without impacting each other face-to-face, potentially rotating 360 degrees or more relative to each.

For embodiments having a one or a plurality of hinges 125 mounted on frame surface 155 or shutter recessed surface 226, the fabrication time may be reduced as compared to other shutter assemblies that use a pair of facing mortises for each hinge because the surfaces 155, 226 may be cut along the full length of the stock material (the future side member of the frame or the future stile of the shutter, as examples) before the size of the frame and the shutter are determined or before the stock material is cut to length. A full length cut is simpler and may require less set-up time than would the arrangement and cutting of an appropriately positioned and sized mortise. A single lengthwise cut along a piece of stock material replaces multiple individual mortises, one for each spaced-apart hinge of a traditional hinge-mounting method. The stock material may be pre-painted, including the surfaces where the hinges will be mounted; whereas, the cutting of a mortise is traditionally done after the stock material is pre-painted.

Figure 8:
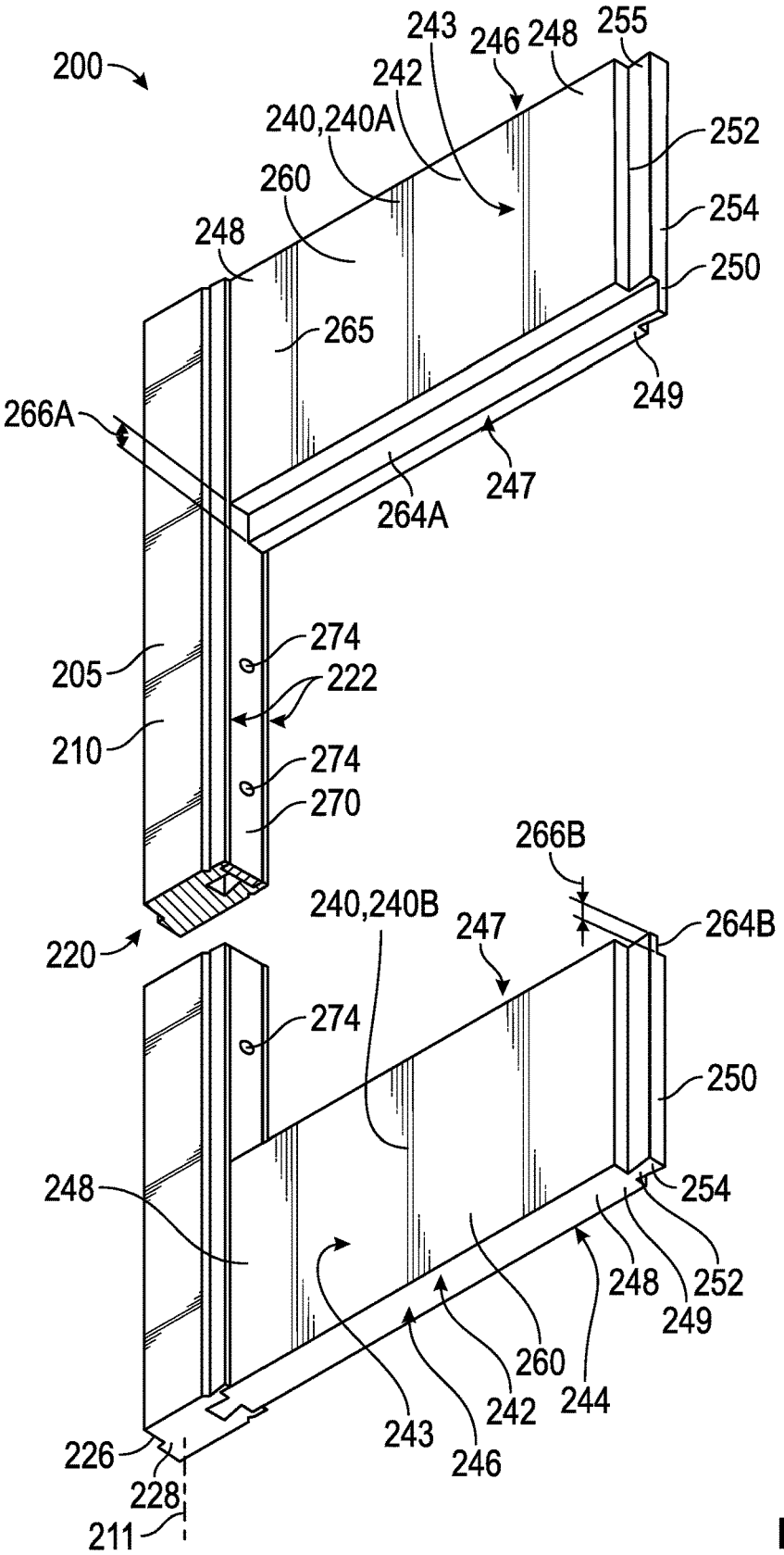
FIG. 8 is a perspective view in partial cross-section of a portion of the shutter panel of FIG. 5.

Referring now to FIG. 6 and FIG. 8, each rail 240 of panel 200 includes a rail body 241, a surface 242, two spaced-apart ends 248, and a central portion 260 extending between ends 248. Surface 242 of rail 240 includes at least four faces in this embodiment: a front rail-face 243, a rear rail-face 244, an elongate perimeter rail-face 246 between the faces 243, 244, and an inside rail-face 247 distal the perimeter rail-face 246. A longitudinally extending rail bisection plane 245 is disposed midway between the front rail-face 243 and rear rail-face 244, is parallel to stile bisection plane 213, and is generally parallel to rail-faces 243, 244 in this embodiment. In at least some embodiments, plane 245 passes through the rail's center of gravity, rail bisection plane 245. Each end 248 has a base portion 249 and a tabbed portion 250 that extends from base portion 249 generally in the direction that rail bisection plane 245 extends. Tabbed portion 250 includes a root feature 252, a body feature 254 extending from root 252, and a longitudinally extending tab bisection plane 258 that bisects root feature 252. Root 252 couples body feature 254 to base portion 249. In this embodiment, body feature 254 includes a width greater than a width of the root 252, and body feature 254 has a variable width that increases as the body feature extends from root 252. When rail 240 is assembled into panel 200, perimeter rail-face 246 is an elongate shutter surface located along the perimeter of panel 200. As best seen in FIG. 6, rail bisection plane 245 is offset from the stile bisection plane 213 by a distance D3, so that louvered panel 200 is an example of a shutter panel having rails that are offset from stiles.

In the example of FIG. 6, the tabbed portions 250 at each rail end 248 share the tab bisection plane 258, and plane 258 is parallel to and offset from the rail bisection plane 245. The tab bisection plane 258 is closer to the front rail-face 243 than is the rail bisection plane 245, making the rail 240 asymmetrical with respect to the rail bisection plane 245 as best shown in the end view of FIG. 6). Consequently, tab bisection plane 258 is closer to the front rail-face 243 than to the rear rail-face 244. Tab bisection plane 258 is co-planer with stile bisection plane 213, and thus, tab bisection plane 258 is offset from the rail bisection plane 245 by the same distance D3.

In some other embodiments, tab bisection plane 258 may be closer to the rear rail-face 244 than is the rail bisection plane 245, and plane 258 may be offset from stile bisection plane 213 if joining-grooves 230 of the stiles are similarly offset from plane 213. Similar comparisons, including the distances, are descriptive of the tab bisection planes 213, 245, 258 of shutter 200B in FIG. 7. For shutter 200, the distance between the rear rail-face 244 of rail 240 and the rear stile-face 218 of stile 210 will be designated as a rear face-to-face distance D4. Distance D4 is less than a front face-to-face distance D5 between the front rail-face 243 of the same rail 240 and the front stile-face 216 of the same stile 210. In this description, stile 210 refers to any stile 210A, B, C, D, and rail 240 refers to either of the rails 240 of a same shutter 200A, 200B.

Referring still to FIG. 6 and FIG. 7, to facilitate the assembly of rail 240 with stile 210, the rail's tabbed portion 250 has a cross-sectional shape corresponding to the shape of the inner, portion 232 of the stile's groove 230, which in this embodiment is trapezoidal. The rail's base portion 249 has a cross-sectional shape corresponding to the shape of outer portion 233 of the stile's groove 230, which in this embodiment is rectangular. As a consequence, ends 248 of rails 240 are adapted to be slidingly received and transversely restrained within the grooves 230 of the pair of opposing stiles 210. Tabbed portion 250 of rail 240, having a trapezoidal shape, is also called a dovetail. The trapezoidal inner portion 232 of groove 230 is also called a dovetail channel. The coupling of the tabbed portion 250 with the groove 230 forms an interlocked joint 265, preventing rail 240 from moving relative to stile 210. Interlocked joint 265 is also called a dovetail joint. Furthermore, interlocked joints 265, when applied to a pair of stiles 210 and a pair of rails 240, may retain inserts 270 and louvers 325 within louvered panel 200. A frictional fit, an adhesive, and/or a fastener (not shown) at joint 265 restricts or prevents the movement of rail 240 along stile axis 211. Rail bisection plane 245 is parallel to stile axis 211. Joints other than dovetail joints may be used in various embodiments to join a stile to a rail. In the example shown, a portion of the front rail-face 243 extends into the grooves 230 of the stiles 210, and no portion of the rear rail-face 244 extends into grooves 230.

In FIG. 6 and FIG. 7, central portion 260 of rail 240 is characterized by the width measured between front rail-face 243 and rear rail-face 244 that is greater than the front-to-rear width of the base portions 249 at the ends 248. In various other embodiments, central portion 260 has a width that is less than or greater than the width that is shown.

Referring to FIG. 5 and FIG. 6, the two front stile-faces 216 of the pair of stiles 210, along with the two front rail-faces 243 of the pair of rails 240 on each panel 200 together form a front shutter-face 267. Thus, the front shutter-face includes the front stile-faces 216 and the front rail-faces 243. The front shutter-face 267 may also comprise corresponding faces of louvers 235. Referring now to FIG. 2 and FIG. 6, the two rear stile-faces 218 of the pair of stiles 210 along with the two rear rail-faces 244 of the pair of rails 240 on each panel 200 together form a rear shutter-face 268. Thus, the rear shutter-face 268 includes the rear stile-faces 218 and the rear rail-faces 244. The rear shutter-face 268 may also comprise corresponding faces of louvers 235.

Referring again to FIG. 8, a portion of louver panel 200 is shown with two rails 240 coupled to opposite ends 212 of one of the stiles 210. The two rails will be designated as upper rail 240A and lower rail 240B. An elongate insert 270 having a cross-sectional corresponding to the shape of the outer portion 233 of groove 230 of stile 210 is received therein. Thus, in this embodiment, insert 270 has a generally rectangular-shaped cross section. Insert 270 will also be called a stile insert. As a whole, louvered panel 200 includes a pair of inserts 270 with each insert 270 received within the outer portion of the groove 230 in one of the pair of space-apart, opposing stiles 210. The inserts 270 extend in a direction generally parallel to the groove 230, i.e. generally parallel to stile axis 211. In the embodiment of FIG. 5 and FIG. 8, the combined length that includes the vertical height of two rails and the length of one insert 270 is equal to the length of one stile 210, and so the inserts 270 extend fully between the rails 240.

Continuing to reference FIG. 5 and FIG. 8, insert 270 includes a series of spaced-apart holes 274 that face the inner region of panel frame 205. In an assembled louver panel 200, cylindrical axis pins 326 of the multiple louvers 325 are rotationally received within the holes 274 of opposing inserts 270. The centers of holes 274 and the axis of rotation of pins 326 are mutually aligned and disposed on the stile bisection plane 213 (FIG. 6 and FIG. 7), and therefore holes 274 and pins 326 are offset from the rail bisection plane 245. In at least some embodiments, the arrangement in which holes 274 and pins 326 are offset from the rail bisection plane 245 allows the louvers 325 to close in a more vertical position for panel 200 than do louvers on a conventional louvered panel. The more-vertical orientation of louvers 325 when closed may block more ambient light coming from multiple directions or may block more light coming from a particular direction (for example, light coming from above or from below the center of panel 200).

As shown in FIG. 8, surface 242 of upper rail 240A includes a longitudinal corner recess 264A adjoining the inside face 247 and being open in the direction of front rail-face 243. Recess 264A extends between the two ends 248. Surface 242 of lower rail 240B includes a longitudinal corner recess 264B adjoining the corresponding inside face 247 and being open in the direction of rear rail-face 244. Upper and lower recesses 264A, 264B are configured to receive an elongate edge of one of the plurality of louvers 325. The height 266A of the upper recess 264A on upper rail 240A is longer than the height 266B of lower recess 264B on lower rail 240B because the upper recess 264A is configured to receive the fastener that connects lifting bar 328 to the uppermost louver 325 so that a conventional rounded groove or "mouse hole" is not needed (and is therefore not shown) in the front rail-face 243 of upper rail 240A. A portion of upper recess 264A is also visible in the front elevation view of FIG. 5. In some embodiments, height 266A of upper recess 264A is sufficiently large to receive the upper end of lifting bar 328. The arrangement in which holes 274 and pins 326 are offset from the rail bisection plane 245, as previously discussed, may help facilitated or may improve the capability of the upper recess 264A to receive the fastener of lifting bar 328. In various other embodiments, the upper recess 264A may also receive the upper end of lifting bar 328.

Figure 9:
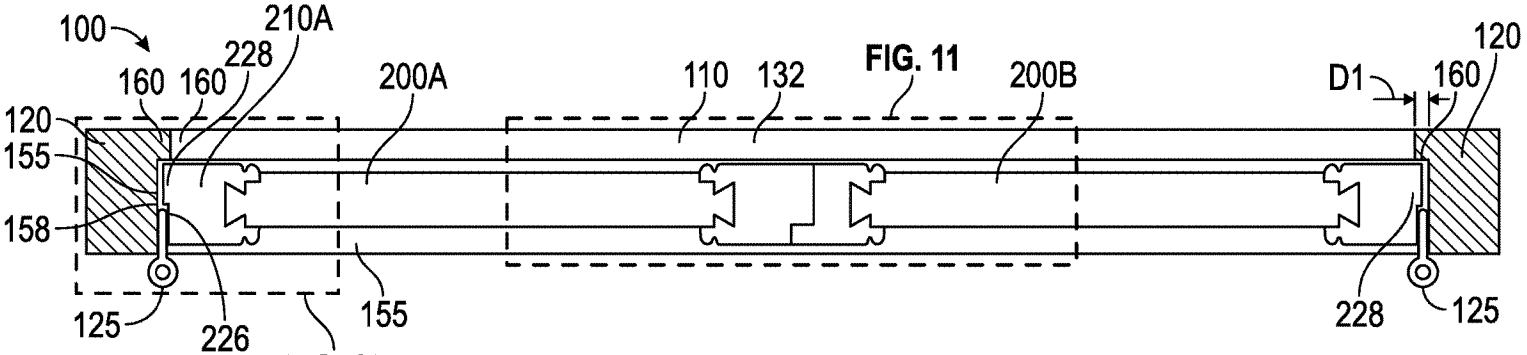
FIG. 9 is an end view of the shutter assembly of FIG. 1 along the section A-A showing the two shutter panels in a closed position with respect to the frame.

Referring now to the sectional view of FIG. 9, louvered panels 200 are shown in a closed position in which, for each panel 200A, 200B, the shutter-ledge 228 of outer stile 210A, 210C is received adjacent the inwardly-facing frame surface 155 of the frame 110 and are disposed adjacent the shoulder of frame-ledge 160 or, similarly, are disposed adjacent the interior frame-face 158. In this closed configuration, the pair of rails 240 of each panel 200 is received in the recessed surface 155 of frame 110, or more specifically within frame surface 155 of the cross members 130, 132, with the rear rail-faces adjacent the corresponding portions of frame-ledge 160. Of course, in FIG. 9, the upper rail 240A and the upper cross member 130 are not visible.

Figure 10:
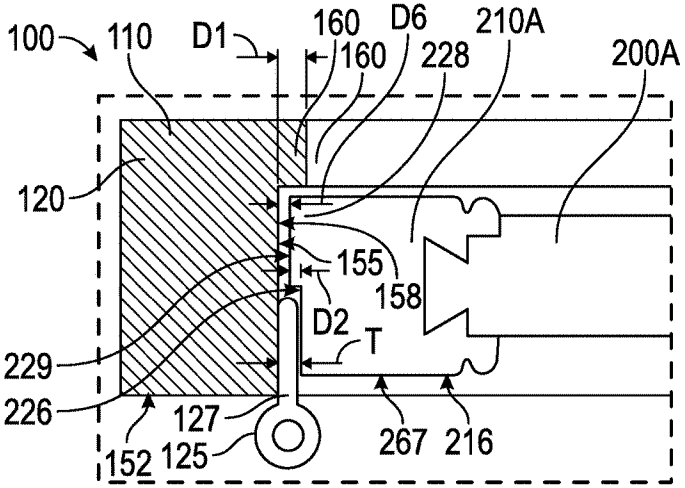
FIG. 10 is a close or enlarged view of the left side of FIG. 9.

Reference will now be given to FIG. 10, which corresponds to the left side of shutter assembly 100 in FIG. 9. The distance D2 that shutter-ledge 228 extends outward from recessed surface 226 is less than the thickness T of mounting plates 127 of hinge 125. Therefore, shutter-ledge 228 is separated from frame 110 (or more specifically, shutter surface 229 is separated from frame surface 155) by a shutter gap of distance D6. Distance D6 is less than the frame-ledge distance D1, configuring frame 110 and panel 200 to block light, that is to say they develop a non-straight path of travel for any light and air that may attempt to pass therebetween. Therefore, the distances D1 and D2 and the various features that define them are configured to eliminate a straight path of travel for light and air. By this arrangement, frame 110 and panel 200 are configured to restrict or block light from traveling between them. Gap distance D6 is also less than the distance between surfaces 155, 226 that defines a hinge gap, i.e. D6 is less than the hinge thickness T. The frame-ledge 160 includes a face that is generally parallel to the rear shutter-faces 268 when the frame 110 and the panels 200 are closed. As viewed from the back (i.e. from the top of FIG. 9), the frame-ledge 160 over-laps the shutter-ledge 228*s* of louvered panels 200 to achieve the light-blocking configuration. This arrangement disclosed for the left side of shutter assembly 100 also pertain to the right side of shutter assembly 100.

Referring still to FIG. 10, when panel 200 is closed, the frame surface 155 and the shutter recessed surface 226 are separated by a distance equal to or greater than the hinge thickness T, such distance forming the hinge gap in which two hinges 125 are disposed, at least in part. Thus, the hinge gap is formed between the shutter panel 200 and the inwardly-facing frame surface 155. The distance equal to or greater than the hinge thickness T defines the width of the hinge gap, and this width extends in a direction parallel to the extension of rail 240. In depth, the hinge gap extends in a direction perpendicular to rail bisection plane 245 partway between the front frame-face 152 and the frame-ledge 160 or partway between the front shutter-face 267 and the frame-ledge 160. In length, the hinge gap extends out of the plane of FIG. 10 and is visible in FIG. 4 being evident from the placement of the two plates 127 of hinge 125. For the embodiment shown, the hinge gap extends along shutter recessed surface 226, having a depth equal to the depth of surface 226 from front stile-face 216. For this discussion, front shutter-face 267 is best represented by front stile-face 216. The width of the hinge gap includes the shutter gap distance D6 and the shutter's recess distance D2. The width of the hinge gap may be formed or positioned differently in some other embodiments. For the embodiment shown, the length of the hinge gap extends vertically, the full-length of shutter recessed surface 226, which extends for full-length of stile 210 (FIG. 4 or FIG. 5). At least a portion of the hinge gap extends lengthwise along the full-length of inwardly-facing frame surface 155.

Figure 11:
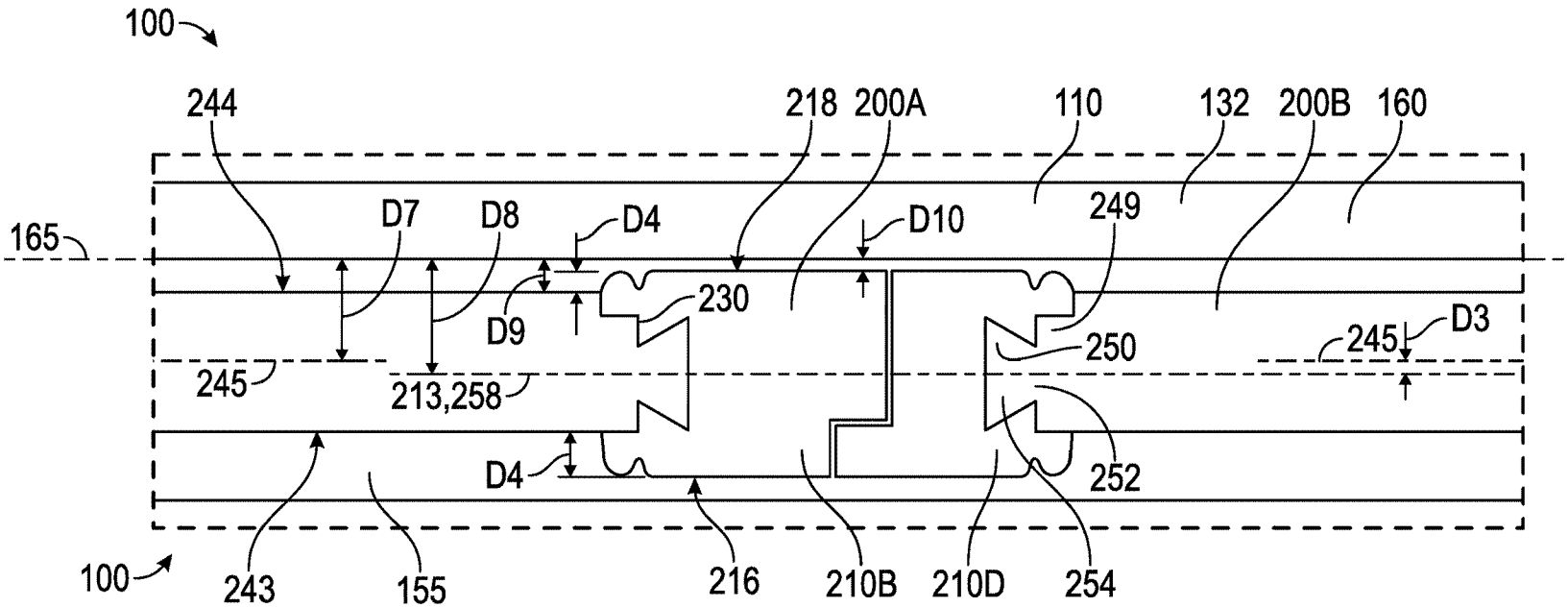
FIG. 11 is a close or enlarged view of the center of FIG. 9.

FIG. 11 shows a close, end view of the center of shutter assembly 100 while in the closed position, as is shown in the center of FIG. 9. Portions of panel 200A, 200B, including inner styles 210B, 210D, are shown received by lower cross member 132. For the frame 110, the shoulder of frame-ledge 160 that adjoins inwardly-facing frame surface 155 lies, at least in part, on a plane 165. Plane 165 is generally parallel to rear rail face 244. The rail bisection plane 245 and stile bisection plane 213 are parallel to plane 165 and cross member 132. The distance D7 between the front face of frame-ledge 160, i.e. plane 165, and the rail bisection plane 245 of the rail 240 is less than the distance D8 between the frame-ledge 160 and the stile bisection plane 213 of the stiles 210. The distance between rear rail-face 244 and frame-ledge 160 is designated by the reference number D9. The distance between the rear stile-face 218 and the frame-ledge 160 is designated by the reference number D10. In FIG. 11, the distance D10 is less than the ledge-to-rail distance D9. Rail 240 and its rear rail-face 244 are closer to frame-ledge 160 of cross member 130, 132, i.e. the ledge-to-rail distance D9 is smaller, than are similar features in conventional shutter assemblies. Distance D9 is influenced by distance D7 between the frame-ledge 160 to the plane 245, which is less than distance D8 between frame-ledge 160 and the plane 213. Distance D9 is influenced by the rear face-to-face distance D4, which is less than the front face-to-face distance D5. This nearness of rear rail-face 244 to frame-ledge 160 in shutter assembly 100 is provided to block more light than conventional shutter assemblies. The distance D10 between the frame-ledge 160 and the rear stile-face 218 is less than the distance D9 between the frame-ledge 160 and the rear rail-face 244 when the shutter panel is in the closed position.

Figure 12:
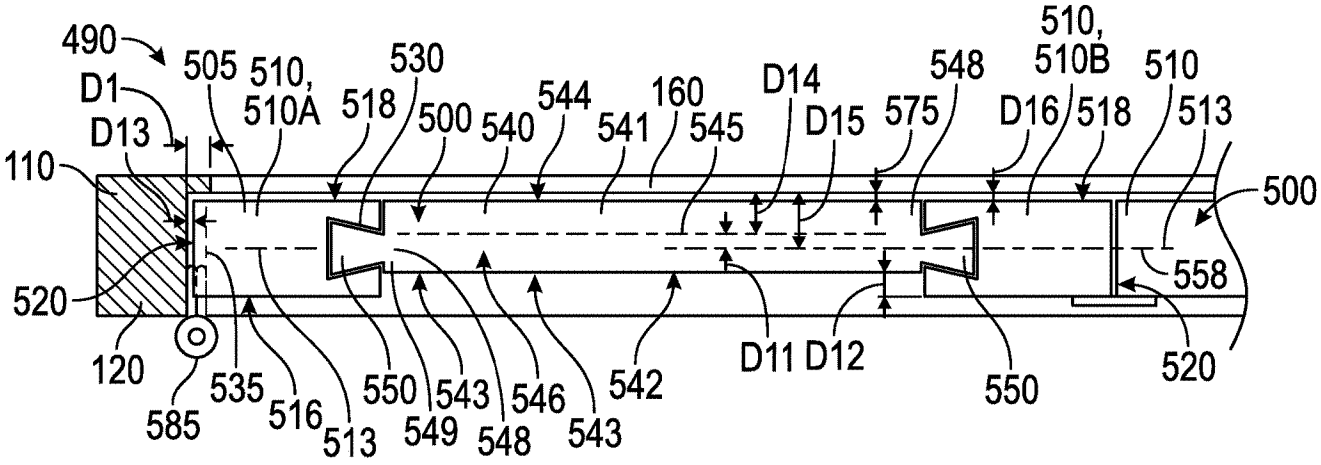
FIG. 12 is an end view in partial cross-section of another embodiment of a shutter assembly in accordance with principles described herein.

In FIG. 12, a shutter assembly 490 is shown to include two shutter panels 500 pivotally coupled to a frame 110 by at least one hinge mounted in a mortise. Frame 110 includes the features described earlier. FIG. 12 shows only a portion of the right-side shutter panel 500, but it is generally similar to the panel 500 on the left side. Describing the panel on the left side, shutter panel 500 includes a panel frame 505 having a pair of parallel, spaced-apart stiles 510 and a pair of parallel rails 540 spaced-apart and extending between stiles 510. Only one of the rails 540 is visible in FIG. 12. The surface of each stile 510 has a front stile-face 516, a rear stile-face 518, a perimeter stile-face 520 between the stile-faces 516, 518. A longitudinally extending stile bisection plane 513 is disposed midway between the front and rear stile-faces 516, 518. The outer stile 510A of the pair includes a joining-groove 530 disposed opposite perimeter stile-face 520 and at least one recess or mortise 535 disposed along stile-face 520 to match the size and to receive the two face-to-face mounting plates of a mortise hinge 585. In some embodiments, a second first mortise 535 is formed in the adjacent frame side member 120, the pair of mortises 535 being sized to match and receive the two face-to-face mounting plates of mortise hinge 585.

Groove 530 in stile 510 includes one portion or section, a trapezoidal portion similar to trapezoidal portion 232 of the groove 230 discussed earlier, but in the example of FIG. 12, groove 530 does not include a rectangular portion. In other examples, stiles 510 may include a joining-groove that has two portions as does the groove 230. The inner stile 510B of the pair is similar to the inner stile 210B described earlier.

Each rail 540 of panel 500 includes a rail body 541, a surface 542 and two spaced-apart ends 548. Three faces of the surface 542 of rail 540 are visible in FIG. 12: a front rail-face 543, a rear rail-face 544, and a perimeter rail-face 546 between the faces 543, 544. A longitudinally extending rail body bisection plane 545 is disposed midway between the front rail-face 543 and rear rail-face 544. For simplicity, rail body bisection plane 545 may also be called a rail bisection plane. Each end 548 has a base portion 549 and a tabbed portion 550 that extends from base portion 549 generally in the direction that rail body bisection plane 545 extends. Rail body bisection plane 545 is offset from the stile bisection plane 513 by a distance D11, so that louvered panel 500 is an example of a shutter panel having rails that are offset from stiles. The distance D14 between the front face of frame-ledge 160 and the rail body bisection plane 545 is less than the distance D15 between the frame-ledge 160 and the stile bisection plane 513.

The tabbed portion 550 at each rail end 548 is received in one of the stile grooves 530 but base portion 549 at each rail end 548 is located outside the stile groove 530 of this embodiment.

The tabbed portions 550 at each rail end 548 are bisected by a tab bisection plane 558, which is parallel to and offset from the rail body bisection plane 545. The tab bisection plane 558 is closer to the front rail-face 543 than is the rail body bisection plane 545, making the rail 540 asymmetrical with respect to the rail body bisection plane 545 as shown in the end view of FIG. 12. In this example, tab bisection plane 558 is co-planer with stile bisection plane 513, and thus, tab bisection plane 558 is offset from rail body bisection plane 545 by the same distance D11. For shutter panel 500, the rear rail-faces 544 of rail 540 are flush, i.e. co-planar, with the rear stile-faces 518 of stiles 510, making the distance between these surfaces zero. The rear rail-faces 544 and the rear stile-faces 518 are equidistant from the frame-ledge 160; this distance will be called a ledge-to-rear shutter-face distance and will be indicated by the reference numeral D16. The front rail-face 543 of rail 540 is offset from the front stile-faces 516 of the stiles 540 by a non-zero distance D12.

When panel 500 is closed, perimeter stile-face 520 of stile 510A is separated from frame 110 (or more specifically, from inwardly-facing frame surface 155) by a distance D13 that is less than the frame-ledge distance D1, configuring frame 110 and panel 500 for a non-straight path of travel for any light and air that may attempt to pass therebetween. Likewise, they are configured to eliminate a straight path of travel for light and air. By this arrangement, frame 110 and panel 500 are configured to restrict or block light from traveling between them.

Thus, FIG. 12 is an example of shutter assembly with a shutter panel having rails that are offset from stiles but without a full-length shutter recessed surface located on a shutter panel to receive a hinge and without a full-length light-blocking panel ledge adjacent the hinge. Even so, the proximity of the rear rail-face 544 to the frame-ledge 160, as measured by the distance D16, provides an additional light-blocking capability as compared to a shutter assembly having a rear rail-face that is inset from the rear stile-faces 518 such that the rear rail-face is therefore located further from frame-ledge 160.

In at least some embodiments, shutter panel 500 is a louvered panel, including fixed or rotatable louvers. Although, shutter panel 500 in FIG. 12 includes the mortise hinge 585 mounted in mortise 535; various other embodiments include a non-mortise hinge installed in mortise 535. Although this embodiment does not include a full-length shutter recessed surface 226 and a full-length light-blocking shutter-ledge 228, some other embodiments similar to shutter 500 do include these features, possibly as a replacement for mortise 535. At least some of these embodiment include the mortise hinge 585 installed in the groove 226.

Figure 13:
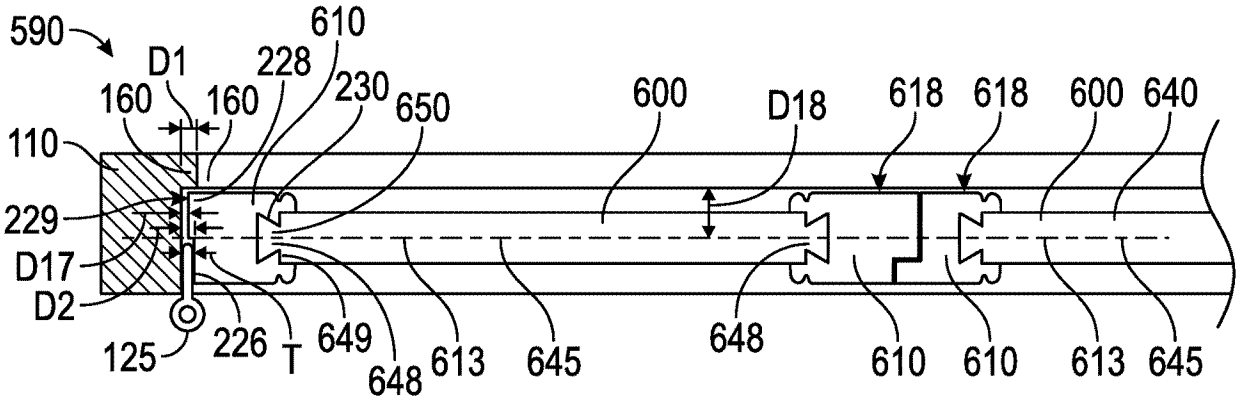
FIG. 13 is an end view of still another embodiment of a shutter assembly in accordance with principles described herein.

FIG. 13 shows a shutter assembly 590 having two shutter panels 600 pivotally coupled to a frame 110 by at least one hinge mounted in a full-length shutter recessed surface 226 on the shutter panel 600. For example, two non-mortise hinges 125 may be used for each of two shutter panels 600, each hinge having a first mounting plate attached to the shutter recessed surface 226 and a second mounting plate attached to the inwardly-facing frame surface 155. For each shutter panel 600, both hinges 125 are positioned within the same recessed surface 226 and along the same surface 155. Frame 110 includes the features described earlier. Each shutter panel 600 includes a pair of stiles 610, each stile having a longitudinal joining-groove 230. The outer stile 610 has a light-blocking shutter-ledge 228 adjacent the hinge and extending a distance D2 outward from recessed surface 226 to an outwardly-facing shutter surface 229, which is less than the thickness T of mounting plate 127 of hinge 125. The inner stile 610 is located near the center of shutter assembly 590. Panel 600 also includes a pair of rails 640 extending between the stiles 610. Each end 648 of each rail 640 includes a base portion 649 and a tabbed portion 650. The end view of FIG. 13 shows only one of the rails 640. Both the tabbed portion 550 and the base portion 549 at each rail end 548 are received in one of the stile grooves 530. Panel 600, may built with or without louvers.

As show in FIG. 13, panel 600 has a stile bisection plane 613 aligned, i.e. co-planar, with a rail body bisection plane 645, which may also be called, simply, a rail bisection plane. When the shutter assembly is closed, i.e. panel 600 is disposed within frame 110, bisection planes 613, 645 are equidistant from frame-ledge 160 on frame 110. This distance is annotated by the reference D18 in FIG. 13. However, considering the surface of shutter panel 600, rear stile-face 618 is closer to frame-ledge 160 than is rear rail-face 644. Thus, shutter panel 600 is an embodiment having a non-mortise hinge mounted in a full-length groove on a shutter panel with a light-blocking panel ledge adjacent the hinge but with rails aligned with stiles instead of having rails that are offset from stiles. Rails 640, including the ends 648 and the tabs 650 are symmetrical with respect to rail body bisection plane 645.

When panel 600 is closed, shutter-ledge 228 on stile 610 is separated from frame 110 (or more specifically, from inwardly-facing frame surface 155) by a distance D17 that is less than the frame-ledge distance D1, configuring frame 110 and panel 600 to restrict or block light by reducing or eliminating any straight path of travel for light and air.

Various methods may be developed in accordance with principles described herein to fabricate or utilize a shutter panel having rails that are offset from stiles, for a shutter with a non-mortise hinge having a light-blocking shutter-ledge behind the hinge, or for a shutter having any combination of the disclosed features. Any of a variety of shutter panels may be utilized, including generally flat, stylized, or louvered panels, for example.

Figure 14:
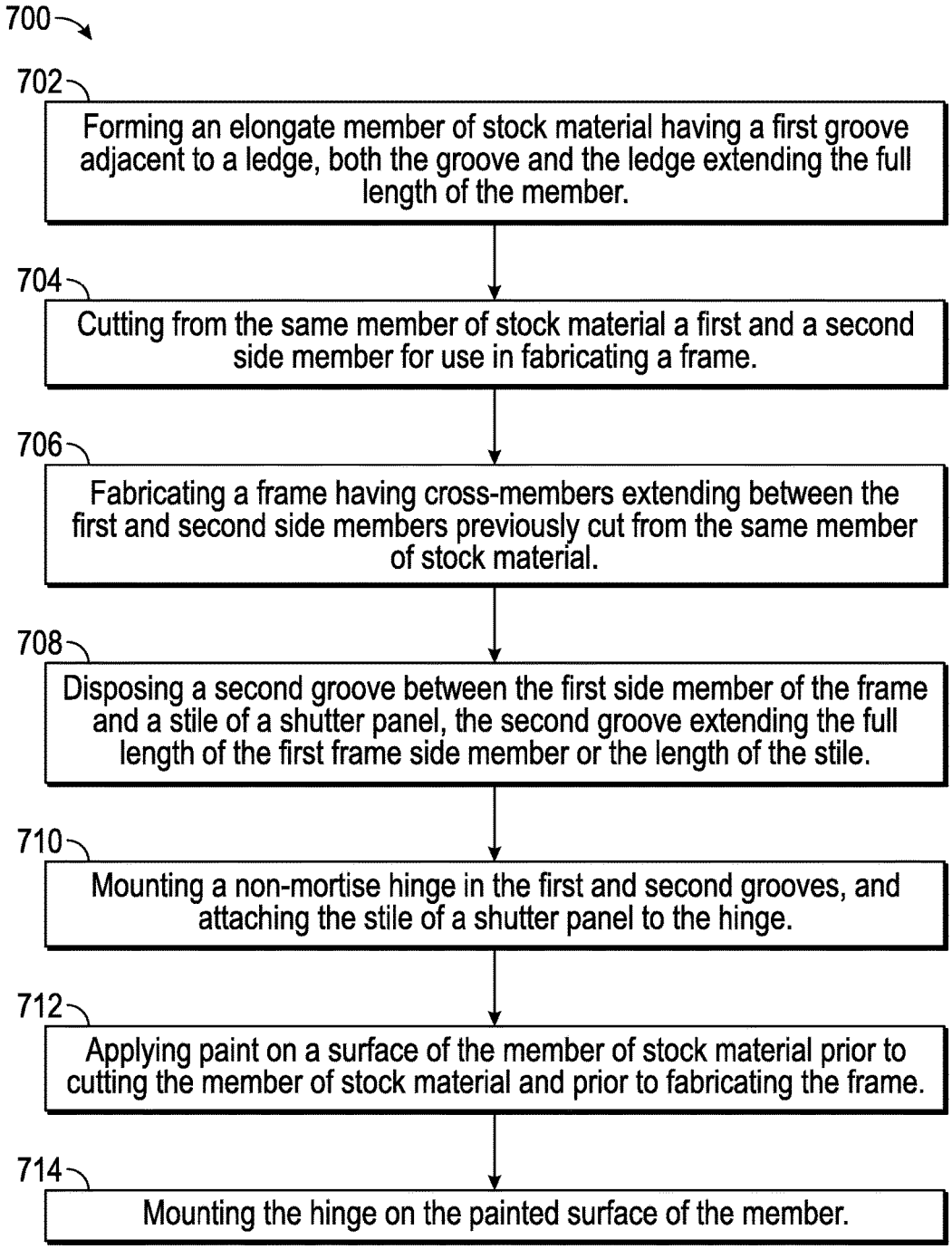
FIG. 14 is a diagram showing steps for fabricating a shutter assembly in accordance with principles described here.

FIG. 14 shows a method 700 for fabricating a shutter in accordance with principles described herein. At block 702, method 700 includes forming an elongate member of stock material having a first groove adjacent to a ledge, both the groove and the ledge extending the full length of the member. Block 704 includes cutting from the same member of stock material a first and a second side member for use in fabricating a frame. Block 706 includes fabricating a frame having cross-members extending between the first and second side members previously cut from the same member of stock material. Block 708 includes disposing a second groove between the first side member of the frame and a stile of a shutter panel, the second groove extending the full length of the first frame side member or the length of the stile. Block 710 includes mounting a non-mortise hinge in the first and second grooves, and attaching the stile of a shutter panel to the hinge. In some embodiments, the groove and the hinge are disposed between first side member and the stile.

As shown in Blocks 712, 714, some embodiments of the method also include applying paint on a surface of the member of stock material prior to cutting the member of stock material and prior to fabricating the frame, and thereafter mounting the hinge on the painted surface of the member. In some embodiments, the second groove is formed in the stile.

Various embodiments of method 700 may include fewer operations than described, and other embodiments of method 700 include additional operations. In some instances, a manufacturing, shipping, or installation advantage is gained by choosing specific sequences for various operations of method 700.

Various embodiments consistent with the present disclosure have been expressly presented. Multiple additional variations and uses are possible in accordance with principles described herein. For example, various embodiments of stiles include a longitudinally extending groove having a shape different than combination of a rectangular portion and a trapezoidal portion of groove 230, and the method for assembling the shutter panel may be adjusted to compensate. For example, a groove may be rectangular with no trapezoidal portion, or a groove may include a rounded cross-section. In such embodiments, the tabbed portions of the rails are shaped to fit properly within the corresponding groove.

Although shutter assemblies shown in the various figures include two shutter panels, some embodiments configured in accordance with principles described herein include one, three, four, or any practical plurality of pivoting shutter panels, and at least one shutter panel is configured to be opened, closed, or latched with respect to frame 110. In some shutter assemblies, frame 110 includes a central member parallel to stiles 210 and disposed between stiles 210. Although the orientation shown for frame 110 includes side members 120 positioned vertically and cross members 130, 132 positioned horizontally, other orientations are possible for frame 110 and its side members 120 and cross members 130, 132. Although the orientation of the various shutter panels 200, 500, 600 within frame 110 are shown or may be suggested to have the corresponding panel stiles positioned vertically and the corresponding panel rails positioned horizontally, other orientations are possible.

Some embodiments having louvers may be fabricated without any inserts 270. Instead, the pins 326 may be positioned in holes formed in the stiles, for example. Various embodiments of a louvered panel include a louver 355 fixed to or movably coupled to the panel frame 205 without pins 326 coupled to the ends of the louver. In FIG. 8, the two corner recess 264A, B have different sizes; however, some other embodiments includes corner recesses 264 having equal sizes, while still other embodiments include no corner recesses 264.

In some embodiments, the louvered panel is fabricated having cosmetic louvers; as examples, the louvers are rigidly mounted to a panel frame, or the louvers are integral, forming a single unit with the panel frame. In certain other embodiments, the louvered panel 200 is replaced by a panel having no louvers, but including one or more of the light-blocking features of a disclosed shutter panel 200, 500, 600. Although shutter assembly 100, frame 110, and shutter panels 200, 500, 600 have been shown as rectangular, in various embodiments, a shutter assembly, a frame, or a shutter panel that is fabricated in accordance with principles described herein is configured to fit a non-rectangular window or door frame, such as a hexagonal window casing. In some instances, to accomplish an aesthetic, economic, scheduling, or functional advantage, a frame 110, a shutter assembly 100, a shutter panel 200, 500, 600, or any such embodiment, may be coupled to an opening, a casing or another frame in a building even though the opening, casing, or other frame has no window or door. In some instances, a frame 110, a shutter assembly 100, a shutter panel 200, 500, 600, or any such embodiment, may function as a casing or as a door, according to its capability.

Although various embodiments were described as having non-mortise hinges, some embodiments may use a mortise hinge mounted in a mortise, i.e. a recess that is cut to match the size of the hinge, or even a mortise hinge mounted in a shutter recessed surface that is longer than the hinge and may extend the full-length of a stile, such as shutter recessed surface 226 for example. Various mortise hinges include a pair of mounting plates attached by a pin for rotation, the attachment being such that the mounting plates are positioned face-to-face when closed, potentially impacting each other and limited to less than 360 degrees of relative rotation.

In the example of FIG. 9 and FIG. 10, front shutter-face 267 or, more specifically, front stile-face 216 is in-set from front frame-face 152. In various other embodiments, front stile-face 216 is flush with front frame-face 152. Similar modifications are possible for the embodiments of FIG. 12 and FIG. 13.

When describing FIG. 10 and FIG. 13, the distance D2 that shutter-ledge 228 extends outward from recessed surface 226 was described as being less than the thickness T of one mounting plate 127 of hinge 125. In various embodiments, the distance D2 is equal to the distance T, making the related distance D6, or D17 zero or nearly zero. In various other embodiments, distance D2 is greater than the dimension T with other features accommodating this difference; as examples, a spacer may be placed between mounting plate 127 and a stile or a frame side member, or a mortise hinge having two mounting plates face-to-face may be installed.

While exemplary embodiments have been shown and described, modifications thereof can be made by one of ordinary skill in the art without departing from the scope or teachings herein. The embodiments described herein are exemplary only and are not limiting. Many variations and modifications of the apparatuses and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A shutter assembly comprising:

a frame comprising a pair of elongate side members and a pair of elongate cross members extending between the pair of side members; wherein a first side member of the pair of side members includes an inwardly-facing frame surface in a region between the pair of cross members, and a frame-ledge extending inward beyond the inwardly-facing frame surface by a distance (D1);

a shutter panel comprising a first stile pivotally coupled to the first side member of the frame, the shutter panel configured to swing between a closed position and an open position relative to the frame, wherein the first stile includes a shutter recessed surface that extends the full-length of the first stile, and a shutter-ledge extending outwardly beyond the shutter recessed surface; and a hinge having a first mounting plate defined by a first pair of planar surfaces and mounted to the shutter recessed surface of the shutter panel, and a second mounting plane defined by a second pair of planar surfaces and attached to the inwardly-facing frame surface, wherein the first pair of planar surfaces are coplanar with the second pair of planar surfaces when the shutter panel is in the closed position;

wherein the shutter-ledge is disposed adjacent to the frame-ledge when the shutter panel is in the closed position.

2. The shutter assembly of claim 1 wherein the shutter panel further comprises:

a front shutter-face;

a rear shutter-face;

wherein the shutter recessed surface extends from the front shutter-face toward the rear shutter-face;

wherein the frame-ledge includes a face that is generally parallel to the rear shutter-face of the shutter panel when the shutter panel is closed; and wherein the shutter-ledge includes an outwardly-facing shutter surface facing the inwardly-facing frame surface and separated from the inwardly-facing frame surface by a predetermined gap when the shutter panel is closed; and wherein when the shutter panel is closed, the frame-ledge extends inwardly beyond the gap and beyond the outwardly-facing shutter surface.

3. The shutter assembly of claim 2 wherein the inwardly-facing frame surface of the frame spans the entire distance between the pair of cross members.

4. The shutter assembly of claim 2 wherein the second mounting plate has a thickness that extends beyond the inwardly-facing frame surface by a dimension that is less than (D1).

5. The shutter assembly of claim 4 wherein the hinge is not disposed in a mortise.

6. The shutter assembly of claim 1 wherein the shutter panel further comprises:

a second stile, each stile having a front stile-face, a rear stile-face, and a stile bisection plane passing midway between the front and rear stile-faces; and a first and a second rail spaced apart and extending between the stiles, each rail having a front rail-face, a rear rail-face, and a rail bisection plane passing midway between the front and rear rail-faces;

wherein the rail bisection plane of the first rail is offset from the stile bisection plane of the first stile.

7. The shutter assembly of claim 6 wherein a distance between the frame-ledge and the rail bisection plane is less than a distance between the frame-ledge and the stile bisection plane when the shutter panel is in the closed position.

8. The shutter assembly of claim 6 wherein a distance between the frame-ledge and the rear stile-face is less than a distance between the frame-ledge and the rear rail-face, at least when the shutter panel is in the closed position.

9. The shutter assembly of claim 1 wherein when the shutter panel is in the closed position, the shutter recessed surface is substantially parallel to the inwardly-facing frame surface.

10. A shutter assembly comprising:

a frame comprising:

a first and a second side member;

a first and a second cross member extending between the side members and spaced apart from one another;

a front frame-face;

a rear frame-face spaced apart from the front frame-face;

an inwardly-facing frame surface extending from the front frame-face toward the rear frame-face; and a frame-ledge extending away from the inwardly-facing frame surface; and a shutter panel pivotally coupled to the frame by a non-mortise hinge, the shutter panel comprising:

a front shutter-surface;

a rear shutter-surface spaced apart from the front shutter-surface; and a shutter recessed surface extending from the front shutter-face toward the rear shutter-surface, wherein the non-mortise hinge is coupled to the shutter recessed surface, and wherein the shutter recessed surface extends from the front shutter-surface to a shutter-ledge;

wherein when the shutter panel is closed, a hinge gap extends between the shutter panel and the inwardly-facing frame surface and the hinge is at least partially disposed the hinge gap.

11. The shutter assembly of claim 10 wherein wherein the hinge gap is formed between the shutter recessed surface and the inwardly-facing frame surface when the shutter panel is closed.

12. The shutter assembly of claim 11 wherein a distance between the inwardly-facing frame surface and the shutter-ledge is less than a distance between the inwardly-facing frame surface and the shutter recessed surface.

13. The shutter assembly of claim 11 wherein the hinge includes a first mounting plate attached to the shutter recessed surface and a second mounting plate attached to the inwardly-facing frame surface; and wherein the first and the second mounting plates are at least partially disposed in the hinge gap when the shutter panel is closed; and wherein, when the shutter panel is closed, the first and the second mounting plates are aligned.

14. The shutter assembly of claim 13 wherein a combined thickness of the first and the second mounting plates is equal to a thickness T; and wherein when the shutter panel is closed, a distance between the shutter ledge and the inwardly-facing frame surface is less than T.

* * * * *